US007143570B2

(12) United States Patent
Piat

(10) Patent No.: US 7,143,570 B2
(45) Date of Patent: Dec. 5, 2006

(54) THREAD HAVING PROPERTIES OF RESISTANCE TO CUTTING

(75) Inventor: Claude Piat, Abondant (FR)

(73) Assignee: API Seplast, Gennevilliers (FR)

( * ) Notice: Subject to any disclaimer, the term of this patent is extended or adjusted under 35 U.S.C. 154(b) by 0 days.

(21) Appl. No.: 10/860,794

(22) Filed: Jun. 3, 2004

(65) Prior Publication Data

US 2005/0022494 A1 Feb. 3, 2005

(30) Foreign Application Priority Data

Jun. 6, 2003 (FR) ..... 03 06872

(51) Int. Cl.
*D02G 3/02* (2006.01)

(52) U.S. Cl. ..... 57/229

(58) Field of Classification Search ..... 57/210, 57/229, 230, 232

See application file for complete search history.

(56) References Cited

U.S. PATENT DOCUMENTS 3,404,409 A 10/1968 Tillotson et al.
4,272,568 A * 6/1981 Berend ..... 427/261
5,568,657 A 10/1996 Cordova et al.
5,845,476 A 12/1998 Kolmes
6,532,724 B1 * 3/2003 Patrick ..... 57/229
2002/0011062 A1 1/2002 Patrick

FOREIGN PATENT DOCUMENTS

EP 0 482 618 A1 10/1991
EP 1 180 555 A1 2/2002

OTHER PUBLICATIONS

Search Report for French Application No. 03 06872, dated Feb. 20, 2004, 2 pages.

* cited by examiner

*Primary Examiner*—Shaun R. Hurley
(74) *Attorney, Agent, or Firm*—Harness, Dickey & Pierce, P.L.C.

(57) ABSTRACT

The invention concerns a thread possessing properties of resistance to cutting, comprising at least one core thread (2) sheathed with at least one sheathing thread (3) consisting of continuous fibers or filaments, characterized in that the core thread (2) is a multifilament thread comprising from 50 to 1800 continuous glass filaments (4). The invention also concerns equipment for protecting against cutting produced from such a thread and a method of producing such equipment.

15 Claims, 1 Drawing Sheet

THREAD HAVING PROPERTIES OF RESISTANCE TO CUTTING

CROSS-REFERENCE TO RELATED APPLICATIONS

This application claims priority to French Application No. 0306872, filed Jun. 6, 2003, which is incorporated by reference herein.

BACKGROUND AND SUMMARY

The invention concerns a thread having properties of resistance to cutting, equipment for protecting against cutting, in particular a glove, produced from such a thread, and a method of producing such an item of equipment.

Glass filaments are known for having properties of resistance to cutting. This resistance can be defined with respect to the French and European standard NF EN 388, which concerns gloves for protection against mechanical risks. It was proposed, in the document FR-2 818 503, to manufacture a glove for protecting against cutting using a knitting of glass filaments each sheathed with one or more threads. Use is therefore made of a sheathed single-filament core thread which is knitted in order to form the glove. However, a single-filament core thread has too great a stiffness to allow comfortable use of the glove produced from such a thread.

It is known, from the documents U.S. Pat. No. 5,568,657, EP-1 180 555, US-2002/011062 and U.S. Pat. No. 5,845,476, threads having properties of resistance to cutting comprising a multifilament core thread comprising a plurality of continuous glass filaments. However, the number of glass filaments is not adjusted so that, at a given numbering, the thread provides a great flexibility and a great resistance to repeated flexions.

The invention aims to mitigate this drawback by proposing a thread having properties of resistance to cutting comprising one or more sheathed multifilament core thread, the core thread being a multifilament thread wherein the number of filaments is adjusted to provide a greater flexibility and a greater resistance. The glove produced from such a thread has characteristics of resistance to cutting in accordance with NF EN 388, in particular with regard to resistance to cutting by slicing, and flexibility adapted to its use, as well as a great durability. To this end, the invention concerns a thread having properties of resistance to cutting comprising at least one core thread sheathed with at least one sheathing thread consisting of continuous fibres or filaments, the core thread being a multifilament thread comprising 50 to 1800 continuous glass filaments whose diameter varies from 5 to 15 micrometers. Therefore, at a given numbering, the core thread is more flexible and more resistant to repeated flexions.

According to a second aspect, the invention concerns equipment for protecting against cutting such as a glove, comprising knitted fabric of at least one thread as described above. Such a glove is therefore comfortable and has an important durability.

According to a third aspect, the invention concerns a method of producing such protective equipment comprising the following steps:

- sheathing at least one core thread with at least one sheathing thread so as to produce a thread as described above;
- knitting, in the form of protective equipment, at least one such thread, for example on a straight-line knitting machine;
- at least partially covering the knitted fabric with one or more layers of covering, for example by soaking.

Other objects and advantages of the invention will emerge during the following description given with reference to the accompanying drawing.

DETAILED DESCRIPTION

Figure 1:
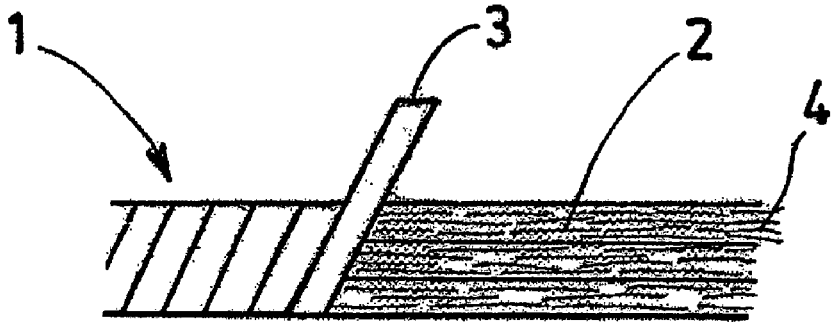
FIG. 1 is a schematic representation of a thread according to the invention, this thread comprising three multifilament core threads sheathed with a sheathing thread.

The thread 1 according to the invention comprises one or more core threads 2 sheathed with one or more sheathing threads 3. In the embodiment depicted in FIG. 1, the thread 1 comprises three core threads 2 and one sheathing thread 3 for the purpose of simplification.

The core thread 2 is a multifilament thread comprising a plurality of continuous glass filaments 4. These filaments 4 may be twisted or not and the core thread 2 may have various numberings. It should be noted that, for equal numbering, a single filament thread is stiffer than a multifilament thread.

In example embodiments, the core thread 2 comprises from 50 to 1800 continuous glass filaments 4 with a diameter which may vary from 15 to 5 micrometers. In a particular example embodiment, the core thread 2 comprises 200 filaments with a diameter of 5 micrometers for a number of 110 dTex. In another example, the core thread comprises 200 filaments with a diameter of 7 micrometers with a number of 220 dTex.

It may be chosen to enrobe a single core thread 2 or several in order to increase the resistance to cutting of the thread 1. Where use is made of several core threads 2 sheathed together, it may be chosen to twist them together or not. The core threads 2 are sheathed with one or more sheathing threads 3, for example by throwing. The sheathing threads 3 can also be multifilament.

The continuous filaments or fibres of the sheathing threads are produced from a material from amongst polyamide, polyester, acrylic, cotton, polyethylene, polypropylene or meta and para aramid. It can also be envisaged to use filaments made from different materials according to the characteristics which it is wished to confer on the thread 1. In a particular embodiment, the core thread 2 is sheathed with two sheathing threads 3 made of polyester having each a number of 110 decitex.

Figure 2:
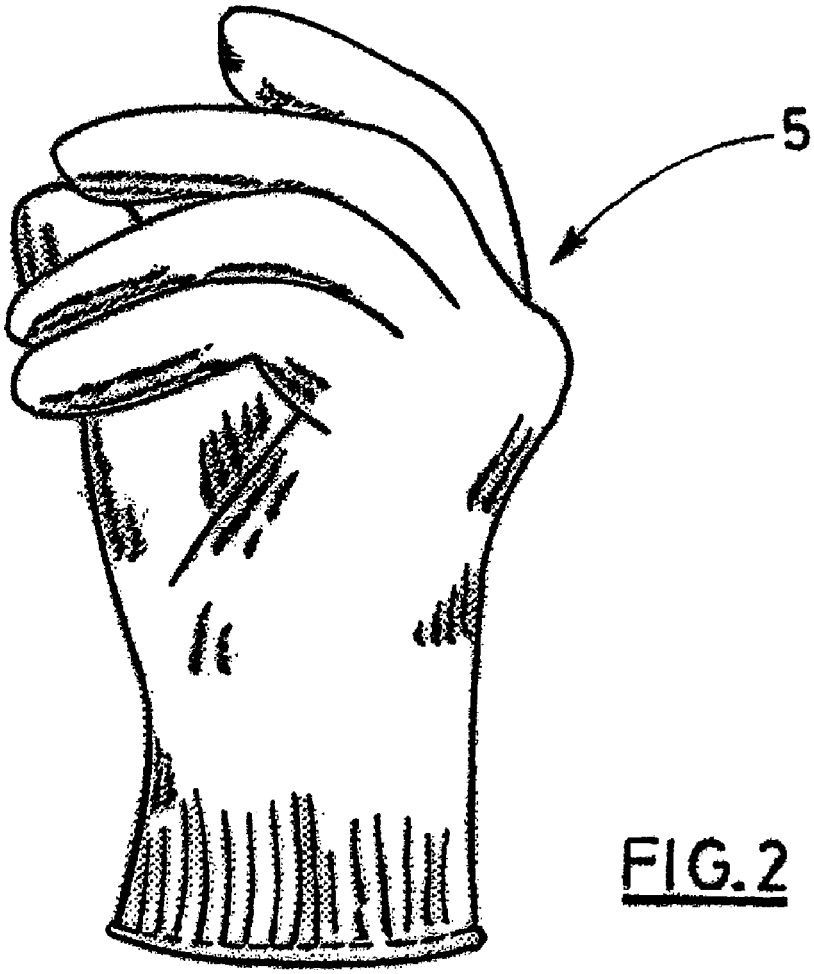
FIG. 2 is a schematic representation of a glove protecting against cutting produced from threads like the one in FIG. 1.

The thread 1, as described above, makes it possible to produce equipment protecting against cutting. Such equipment is for example a protective glove 5, like the one depicted in FIG. 2. The glove 5 comprises a knitted fabric made from at least one thread 1.

This thread can also be knitted with other textile threads, for example with less expensive threads in order to reduce the production costs, whilst keeping a sufficient proportion of glass to ensure the required protection. These threads comprise a plurality of continuous filaments or fibres belonging to the family of polyamide, polyester, acrylic, cotton, polyethylene, polypropylene or meta and para aramid. The glove can comprise an at least partial covering on the knitted fabric. This covering can be a layer of PVC, natural rubber, polyurethane, polychloroprene or nitrile rubber. These materials can be used alone or in a mixture and the covering can comprise several layers.

It is possible to choose to cover the entire glove or only part thereof, such as for example the palm and the top surface of the fingers. The covering can be smooth or rough. When it is rough, the covering improves the hand grip of oily, wet or slippery objects. It can be envisaged terminating the glove with a wrist or sleeve, for example made from cotton, leather or any other material. It suffices to sew the wrist or sleeve to the glove.

The method of producing the protective equipment will now be described. The first step consists of sheathing at least one core thread 2 with at least one sheathing thread 3, for example by throwing, so as to produce a thread 1. At least one thread 1 is then knitted, with the required shape, for example on a straight-line knitting machine. The knitted fabric is at least partially covered with one or more layers of covering, for example by soaking in accordance with known methods. It can then be chosen to make the external layer of the covering rough, for example by powder coating, the spraying of granulates, chemical etching or mechanical etching.

A comparative table is shown below showing various compositions of knitting threads used for producing a protective glove and the corresponding cutting indices (these indices are defined in NF EN 388).

| COMPOSITION OF THREADS OF THE KNITTED FABRIC | % OF GLASS | GLOVE WEIGHT PER SURFACE AREA | CUT-TING LEVEL | CUTTING INDEX |
|---|---|---|---|---|
| 1: Polyester and polyamide fibres | 0% | 543 g/m$^2$ | 3 | 5 |
| 2: Glass filaments, polyester and polyamide fibres | 6% | 543 g/m$^2$ | 4 | 15 |
| 3: Glass filaments, polyester and polyamide fibres | 12% | 543 g/m$^2$ | 5 | 25 |
| 4: Glass filaments, polyester and polyamide fibres | 18% | 543 g/m$^2$ | 5 | 118 |
| 5: Glass filaments Polyester and polyamide fibres, polyethylene with high resistance to cutting | 14% | 796 g/m$^2$ | 5 | 52.3 |
| 6: Glass fibres Polyester and polyamide fibres PVC covering | 12% (lining) | 1774 g/m$^2$ | 4 | 18.3 |

It is seen with this table that, for equal weights per surface area, the resistance to cutting increases with the percentage of glass (cf. Composition 1 to Composition 4).

In Composition 5, the glass is associated with a fibre based on polyethylene having a high resistance to cutting. It can be seen that this association makes it possible to obtain a high index for resistance to cutting. Composition 6 concerns a glove coated with PVC, and the glass is therefore contained in the lining of this glove. When the proportion of glass in the lining is suitable, it is seen that the glove preserves good resistance to cutting after the PVC coating.

The invention claimed is:

1. A thread possessing properties of resistance to cutting, comprising at least one core thread sheathed with at least one sheathing thread, the sheathing thread including continuous fibers, wherein the core thread has a numbering of about 110 decitex and is a multifilament thread comprising about 200 continuous glass filaments, each glass filament having a diameter of about 5 micrometers.

2. A thread according to claim 1, wherein the sheathing thread comprises continuous fibers made from at least one material belonging to the family of polyamide, polyester, acrylic, cotton, polyethylene, polypropylene, and meta and para aramid.

3. A thread according to claim 2, wherein the core thread is sheathed with two sheathing threads made of polyester, each having a number of 110 decitex.

4. A thread according to claim 1, at least partially covered with a layer of PVC, natural rubber, polyurethane, polychloroprene or nitrile rubber, used alone or in a mixture.

5. A thread according to claim 4, wherein the covering also comprises at least one additional layer.

6. A thread according to claim 4, wherein an external layer of the covering is rough.

7. A thread according to claim 6, further comprising making the external layer of the covering rough by powder coating, spraying of granulates, chemical etching or mechanical etching.

8. A cut resistant thread comprising:

at least one sheathing thread having continuous fibers; and at least one multifilament core thread with a numbering of about 110 decitex and having about 200 continuous glass filaments, each glass filament having a diameter of about 5 micrometers:

wherein the at least one core thread is sheathed with the at least one sheathing thread and the cut resistant thread contains from about 6% glass to about 18% glass.

9. The cut resistant thread of claim 8, wherein the sheathing thread is made from at least one of polyamide, polyester, acrylic, cotton, polyethylene, polypropylene, meta aramid and para aramid.

10. The cut resistant thread of claim 8, wherein the at least one core thread is sheathed with two sheathing threads made of polyester, each having a number of 110 decitex.

11. The cut resistant thread of claim 8, wherein the at least one core thread is one of a plurality of core threads and the core threads are twisted together.

12. Cut resistant threads each comprising at least one sheathing thread having continuous fibers and at least one multifilament core thread with a numbering of about 220 decitex and having about 200 continuous glass filaments, each glass filament with a diameter of about 7 micrometers, the at least one multifiliament core thread sheathed with the at least one sheathing thread.

13. The cut resistant threads of claim 12, at least partially covered with a layer of at least one of PVC, natural rubber, polyurethane, polychloroprene and nitrile rubber.

14. The cut resistant threads of claim 13, wherein an external layer of the covering is rough.

15. The cut resistant threads of claim 12, wherein the cut resistant threads contain from about 6% glass to about 18% glass.

* * * * *